US008451211B2

(12) United States Patent
Yu

(10) Patent No.: US 8,451,211 B2
(45) Date of Patent: May 28, 2013

(54) DIMMING CONTROL APPARATUS AND METHOD FOR GENERATING DIMMING CONTROL SIGNAL BY REFERRING TO DISTRIBUTION INFORMATION/MULTIPLE CHARACTERISTIC VALUES DERIVED FROM PIXEL VALUES

(75) Inventor: Chia-Lei Yu, Taipei (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 500 days.

(21) Appl. No.: 12/686,396

(22) Filed: Jan. 13, 2010

(65) Prior Publication Data

US 2011/0169852 A1 Jul. 14, 2011

(51) Int. Cl.
*G09G 3/36* (2006.01)

(52) U.S. Cl.
USPC ..... 345/102; 345/88; 345/89

(58) Field of Classification Search
USPC ..... 345/76–84, 87–102, 204–215, 690–699
See application file for complete search history.

(56) References Cited

U.S. PATENT DOCUMENTS

| | | | | |
|---|---|---|---|---|
| 6,438,298 | B1 * | 8/2002 | Matsui et al. | 385/50 |
| 2009/0021469 | A1 * | 1/2009 | Yeo et al. | 345/102 |
| 2010/0020094 | A1 * | 1/2010 | Park et al. | 345/589 |
| 2011/0193961 | A1 * | 8/2011 | Peterson | 348/148 |

FOREIGN PATENT DOCUMENTS

CN 101399023 A 4/2009

* cited by examiner

*Primary Examiner* — Vijay Shankar
(74) *Attorney, Agent, or Firm* — Winston Hsu; Scott Margo

(57) ABSTRACT

An exemplary dimming control apparatus of generating a dimming control signal for a display area is provided. The dimming control apparatus includes a data analysis module and an output module. The display area includes a plurality of pixels. The data analysis module receives a plurality of first pixel values corresponding to the pixels, respectively, where the first pixel values correspond to a first frame; in addition, the data analysis module derives a first characteristic value corresponding to the first frame according to a distribution of the first pixel values, and generates a first dimming value according to at least the first characteristic value. The output module is coupled to the data analysis module, and generates the dimming control signal corresponding to the first frame according to at least the first dimming value.

26 Claims, 11 Drawing Sheets

DIMMING CONTROL APPARATUS AND METHOD FOR GENERATING DIMMING CONTROL SIGNAL BY REFERRING TO DISTRIBUTION INFORMATION/MULTIPLE CHARACTERISTIC VALUES DERIVED FROM PIXEL VALUES

BACKGROUND

The disclosed embodiments of the present invention relate to controlling a backlight module, and more particularly, to a dimming control apparatus and method for generating a dimming control signal by referring to distribution information (e.g., histogram information) or multiple characteristic values derived from pixel values.

In a conventional liquid crystal display (LCD) apparatus, a light source of a backlight module is commonly implemented by fluorescent tube(s). Due to the advance of the LCD technology, a partially-driven backlight module is developed, where a number of point light sources, such as light emitting diodes (LEDs), are used in a plurality of backlight units implemented for illuminating a plurality of regions of a display panel, respectively and independently. Therefore, the light intensity of the backlight module is partially changed rather than globally changed, which can improve the display quality of the video image.

Thus, as the dimming control (e.g., a local dimming control) of the backlight module would affect the final display quality of the video image, how to properly control the backlight module becomes an important topic to designers in this field.

SUMMARY

In accordance with exemplary embodiments of the present invention, a dimming control apparatus and method for generating a dimming control signal by referring to distribution information (e.g., histogram information) or multiple characteristic values derived from pixel values are proposed.

According to a first aspect of the present invention, an exemplary dimming control apparatus of generating a dimming control signal for a display area is disclosed. The display area includes a plurality of pixels. The exemplary dimming control apparatus includes a data analysis module and an output module. The data analysis module is utilized for receiving a plurality of first pixel values corresponding to the pixels, respectively, where the first pixel values correspond to a first frame; deriving a first characteristic value corresponding to the first frame according to a distribution of the first pixel values; and generating a first dimming value according to at least the first characteristic value. The output module is coupled to the data analysis module, and utilized for generating the dimming control signal corresponding to the first frame according to at least the first dimming value.

According to a second aspect of the present invention, an exemplary dimming control apparatus of generating a dimming control signal for a display area is disclosed. The display area includes a plurality of pixels. The exemplary dimming control apparatus includes a data analysis module and an output module. The data analysis module has a plurality of extraction units, including a first extraction unit and a second extraction unit, and a processing unit. The first extraction unit is utilized for receiving a plurality of first pixel values corresponding to the pixels, respectively, and deriving a first characteristic value corresponding to a first frame according to the first pixel values, where the first pixel values correspond to the first frame. The second extraction unit is utilized for receiving the first pixel values and deriving a second characteristic value corresponding to the first frame according to the first pixel values. The processing unit is coupled to the extraction units, and utilized for generating the first dimming value according to at least the first characteristic value and the second characteristic value. The output module is coupled to the data analysis module, and utilized for generating the dimming control signal corresponding to the first frame according to at least the first dimming value.

According to a third aspect of the present invention, an exemplary dimming control method of generating a dimming control signal for a display area is disclosed. The display area includes a plurality of pixels. The exemplary dimming control method includes the following steps: receiving a plurality of first pixel values corresponding to the pixels, respectively, where the first pixel values correspond to a first frame; deriving a first characteristic value corresponding to the first frame according to a distribution of the first pixel values; generating a first dimming value according to at least the first characteristic value; and generating the dimming control signal corresponding to the first frame according to at least the first dimming value.

According to a fourth aspect of the present invention, an exemplary dimming control method of generating a dimming control signal for a display area is disclosed. The display area includes a plurality of pixels. The exemplary method includes: receiving a plurality of first pixel values corresponding to the pixels, respectively, where the first pixel values correspond to a first frame; deriving a first characteristic value corresponding to the first frame according to the first pixel values; and deriving a second characteristic value corresponding to the first frame according to the first pixel values; generating a first dimming value according to at least the first characteristic value and the second characteristic value; and generating the dimming control signal corresponding to the first frame according to at least the first dimming value.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

In accordance with exemplary embodiments of the present invention, one conception of the present invention is to generate a dimming control signal to a backlight module by referring to information derived from a distribution of pixel values corresponding to pixels of a display area. For example, a characteristic value is derived from the distribution (e.g., a histogram) of pixel values, and then used for determining the required dimming control signal. The other conception of the present invention is to generate a dimming control signal to a backlight module by referring to a plurality of characteristic values derived from pixel values corresponding to pixels of a display area. In other words, more than one characteristic value is derived from the pixel values, and then used for determining the required dimming control signal.

Figure 1:
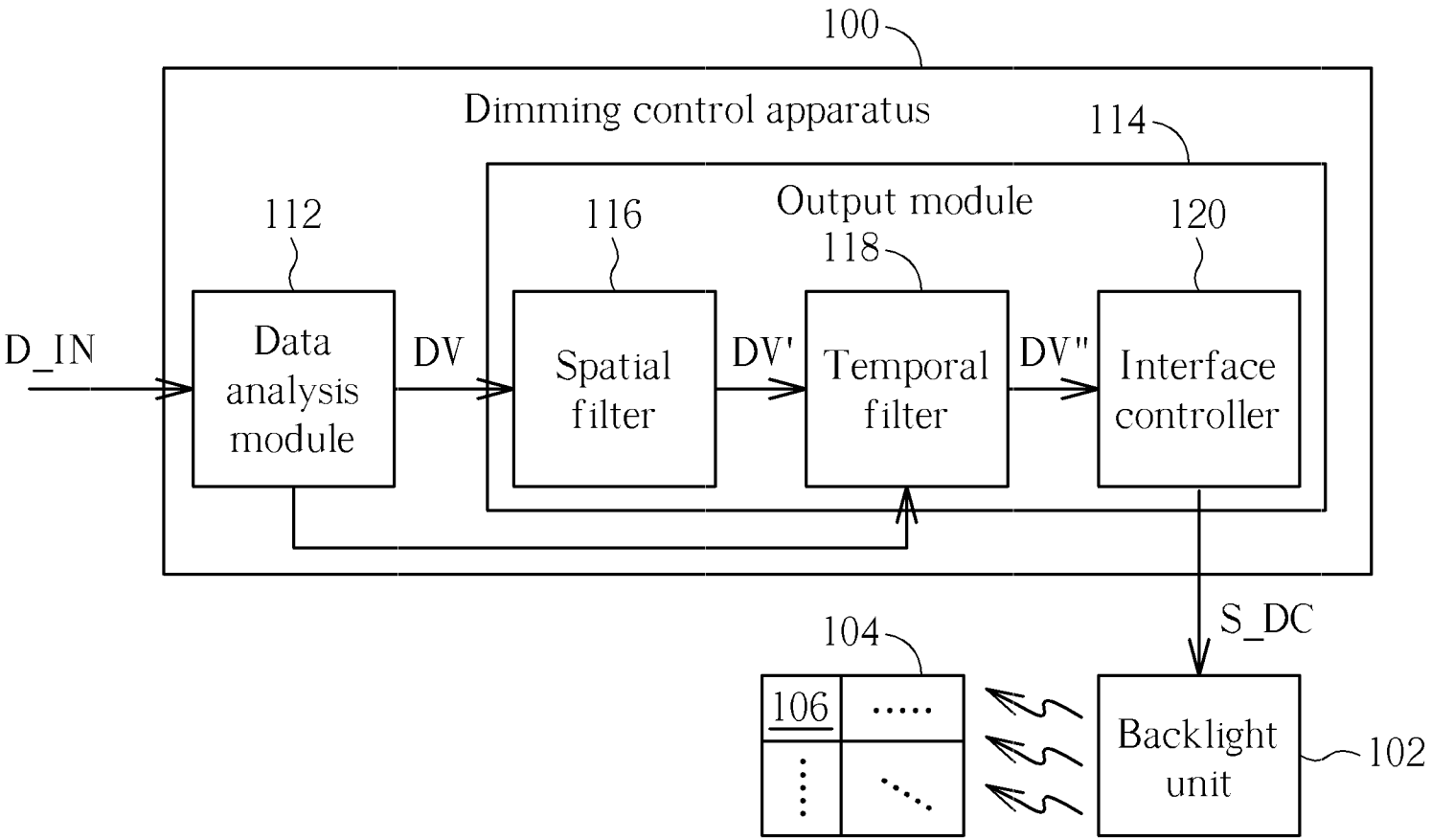
FIG. 1 is a block diagram illustrating an exemplary embodiment of a dimming control apparatus according to the present invention.

FIG. 1 is a block diagram illustrating an exemplary embodiment of a dimming control apparatus 100 according to the present invention. The dimming control apparatus 100 is for performing a dimming control upon a backlight unit 102 utilized for illuminating at least a display area 104 of a display panel, where backlight unit 102 may includes one or more light sources (e.g., LEDs), and the display area 104 includes a plurality of pixels 106. By way of example, but not limitation, the dimming control apparatus 100 may be employed for performing a local dimming control; therefore, the backlight unit 102 is part of a backlight module (e.g., an LED backlight module), and the display area 104 is part of the display panel (e.g., an LCD panel). However, this is for illustrative purposes only, and is not meant to be taken as a limitation of the present invention. That is, any dimming control apparatus employing the proposed scheme for determining a dimming control signal (e.g., a local dimming control signal or a global dimming control signal) falls within the scope of the present invention.

As shown in FIG. 1, the exemplary dimming control apparatus 100 includes, but is not limited to, a data analysis module 112 and an output module 114. In this exemplary implementation, the output module 114 includes a spatial filter 116, a temporal filter 118, and an interface controller 120. The data analysis module 112 receives a video input D_IN from a preceding data processing stage, where the video input D_IN contains video data of a plurality of frames to be displayed on the display panel; in addition, the data analysis module 112 generates a dimming value output DV according to the video input D_IN. In one exemplary embodiment, the distribution information (e.g., histogram information) of pixel values is involved in determining the dimming value output DV. For clarity, an exemplary implementation of the data analysis module 112 which uses the distribution information of pixels is given as follows.

Figure 2:
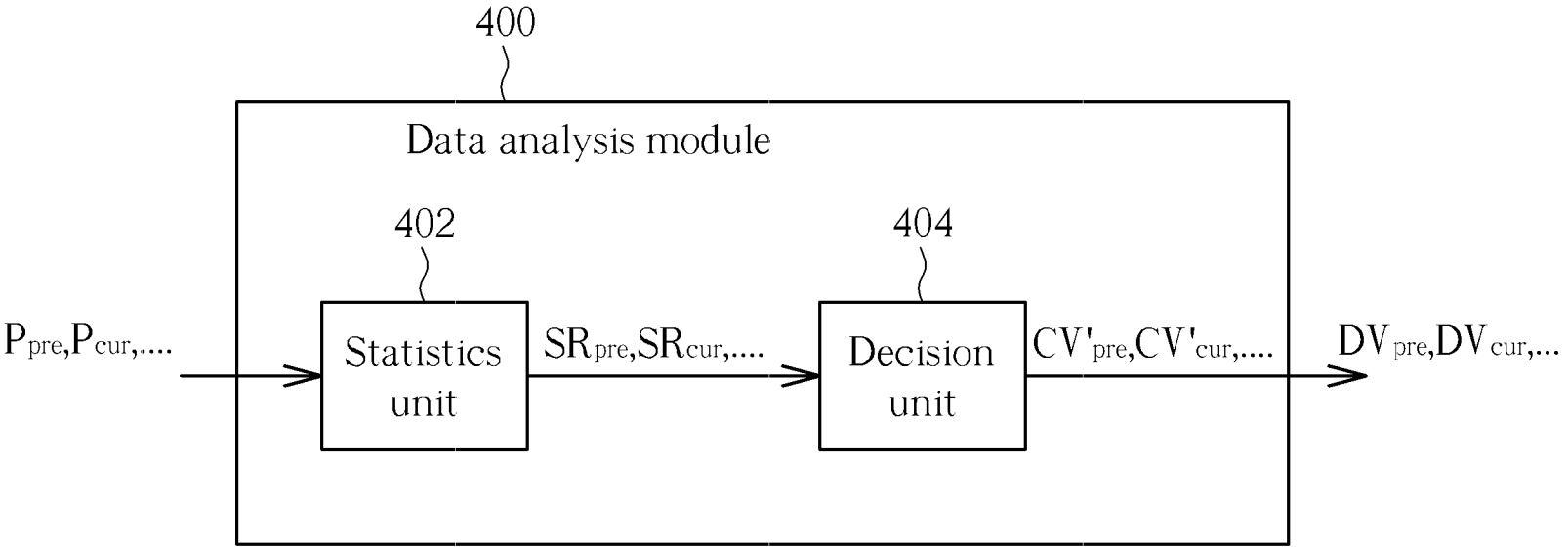
FIG. 2 is a block diagram illustrating a first exemplary implementation of a data analysis module shown in FIG. 1.

Please refer to FIG. 2, which is a block diagram illustrating a first exemplary implementation of the data analysis module 112 shown in FIG. 1. The data analysis module 400 includes a statistics unit 402 and a decision unit 404. To put it simply, the statistics unit 402 is utilized to generate a statistics result according to a pixel value distribution, and the decision unit 404 is coupled to the statistics unit 402, and implemented for deriving a characteristic value according to the statistics result and outputting the derived characteristic value as a desired dimming value. Regarding a first frame (e.g., a current frame), the data analysis module 112 receives a plurality of first pixel values $P_{cur}$ corresponding to the pixels 106 of the display area 104 on the display panel, respectively, and generates a first dimming value $DV_{cur}$ for the display area 104 according to the first pixel values $P_{cur}$. More specifically, the statistics unit 402 receives the first pixel values $P_{cur}$, and generates a first statistics result $SR_{cur}$ according to the distribution of the first pixel values $P_{cur}$. Next, the decision unit 404 derives a first characteristic value $CV'_{cur}$ according to the first statistics result $SR_{cur}$, and outputting the first characteristic value $CV'_{cur}$ as the first dimming value $DV_{cur}$.

By way of example, but not limitation, the statistics unit 402 refers to distribution of the first pixel values $P_{cur}$ to obtain a histogram of the first pixel values $P_{cur}$ as the first statistics result $SR_{cur}$, and then the decision unit 404 processes the histogram of the first pixel values $P_{cur}$ to generate the first characteristic value $CV'_{cur}$. For instance, a histogram with a plurality of bins each corresponding to one pixel level interval can be obtained by analyzing the first pixel values $P_{cur}$, where each bin is mapped to a count number of pixel values falling within a corresponding pixel level interval. Based on the histogram information given by the statistics unit 402, the decision unit 404 sets the first characteristic value $CV'_{cur}$ which is representative of a particular display feature owned by the first pixel values $P_{cur}$ displayed on the display area 104. For example, the decision unit 404 refers to the histogram of the first pixel values $P_{cur}$ to search all bins for a particular bin with a maximum count number or search bins each having a count number greater than a predetermined threshold TH for a particular bin with a maximum/minimum pixel level, and then determines the first characteristic value $CV'_{cur}$ according to the searching result.

Figure 3:
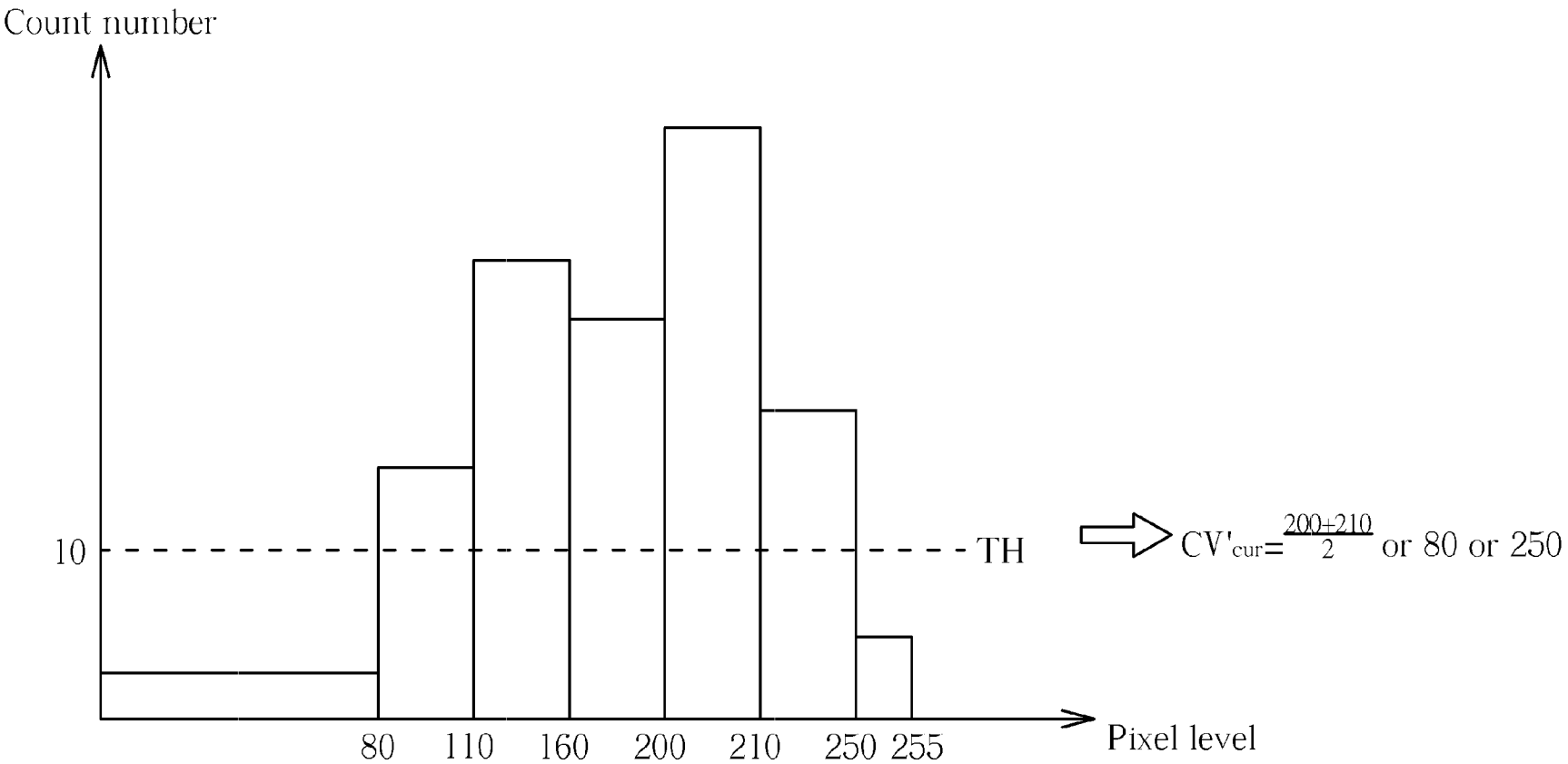
FIG. 3 shows one example of generating a characteristic value according to histogram information.

FIG. 3 shows one example of generating a characteristic value according to the histogram information. Taking the generation of the first characteristic value $CV'_{cur}$ for example, the statistics unit 402 obtains the histogram of the first pixel values $P_{cur}$, where the total number of bins included in the exemplary histogram is 7. In a case where the first characteristic value $CV'_{cur}$ is determined according to a bin with a maximum count number, the decision unit 404 finds that the pixel level interval, ranging from 200 to 210, is mapped to a maximum count number of pixels. In one exemplary implementation, the decision unit 404 may output a middle value (i.e., an average value) of the pixel levels 200 and 210 to act as the first characteristic value $CV'_{cur}$. In another case where the first characteristic value $CV'_{cur}$ is determined according to a bin with a maximum pixel level among bins each having a count number greater than a predetermined threshold TH (e.g., 10), the decision unit 404 finds that the pixel level interval, ranging from 210 to 250, meets the requirement. In one exemplary implementation, the decision unit 404 may output the maximum pixel level 250 of the found bin to act as the first characteristic value $CV'_{cur}$. In yet another case where the first characteristic value $CV'_{cur}$ is determined according to a bin with a minimum pixel level among bins each having a count number greater than a predetermined threshold TH (e.g., 10), the decision unit 404 finds that the pixel level interval, ranging from 80 to 110, meets the requirement. In one exemplary implementation, the decision unit 404 may output the minimum pixel level 80 of the found bin to act as the first characteristic value $CV'_{cur}$.

It should be noted that the above example of using the histogram to find the required characteristic value merely serves as one feasible implementation of the decision unit 404. Any scheme which refers to the statistics information/distribution information/histogram information of pixel values for obtaining required characteristic value obeys the spirit of the present invention. In addition, the histogram shown in FIG. 3 is for illustrative purposes only. The bin number and/or the bin size of the histogram may be programmable. For example, the histogram obtained by the statistics unit 402 may have 256 bins each corresponding to one of the pixel levels 0-255, where each bin is mapped to a count number of pixel values equal to a corresponding pixel level. Moreover, the predetermined threshold TH may be programmable.

Similarly, regarding other frames, the data analysis module 400 follows the same procedure mentioned above to derive the corresponding dimming values. Taking a second frame (e.g., a previous frame) preceding the first frame for example, the statistics unit 402 receives a plurality of second pixel values $P_{pre}$ corresponding to the pixels 106 of the display area 104 on the display panel, respectively. Based on the received second pixel values $P_{pre}$, the statistics unit 402 generates a second statistics result $SR_{pre}$, such as a histogram of the second pixel values $P_{pre}$. Next, the decision unit 404 generates a second characteristic value $CV'_{pre}$ according to the second statistics result $SR_{pre}$, and outputs the second characteristic value $CV'_{pre}$ as a second dimming value $DV_{pre}$. As a skilled person in the art can readily understand details directed to generating the second dimming value $DV_{pre}$ after reading above paragraphs directed to generating the first dimming value $DV_{cur}$, further description is omitted here for brevity.

Figure 4:
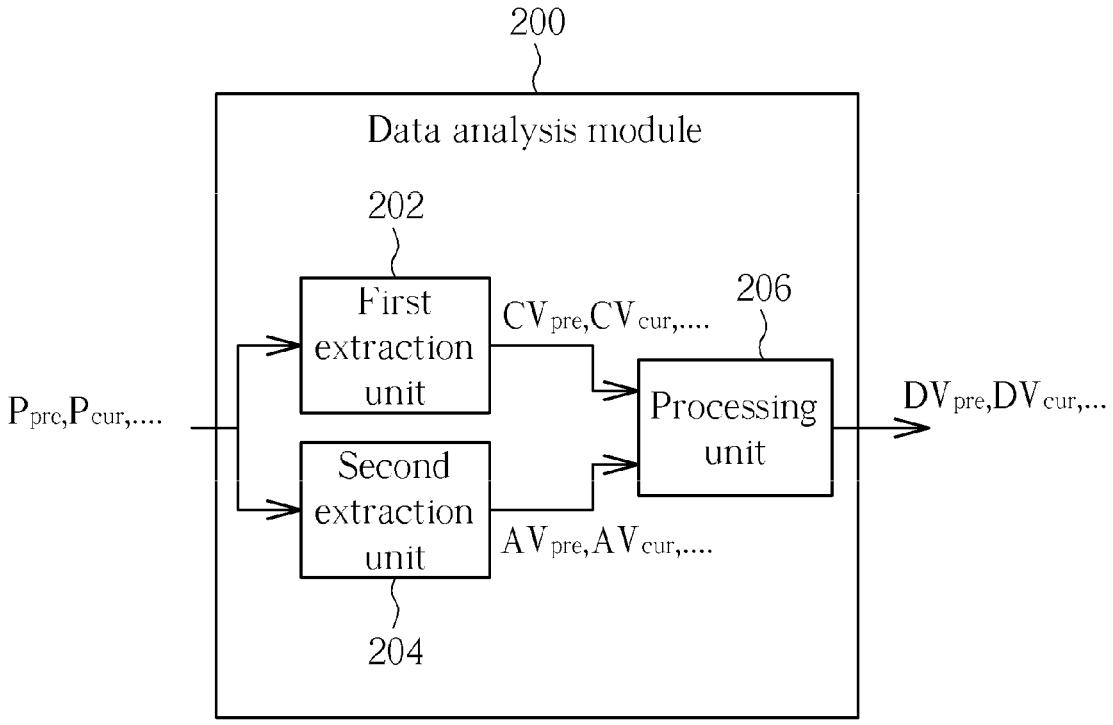
FIG. 4 is a block diagram illustrating a second exemplary implementation of the data analysis module shown in FIG. 1.

In above exemplary implementation of the data analysis module 400 shown in FIG. 2, only one characteristic value is taken into consideration. However, based on the design consideration, referring to more than one characteristic value to generate the desired dimming value is also feasible. FIG. 4 is a block diagram illustrating a second exemplary implementation of the data analysis module 112 shown in FIG. 1. As shown in FIG. 2, the data analysis module 200 has a plurality of extraction units, including a first extraction unit 202 and a second extraction unit 202. However, please note that the number of implemented extraction units is not limited to two, and is adjustable according to actual design consideration. In this exemplary embodiment, the first extraction unit 202 and the second extraction unit 204 derive respective characteristic values from the same input data, and output the derived characteristic values to a processing unit 206. Therefore, the processing unit 206 is devised to generate a dimming value by processing characteristic values received from preceding extraction units. In this exemplary embodiment, the processing unit 206 may perform a weighted blending operation upon characteristic values received from preceding extraction units (e.g., characteristic values obtained by the first extraction unit 202 and the second extraction unit 204) to generate a weighted blending result, and output a dimming value according to the weighted blending result. However, this is for illustrative purposes only, and is not meant to be a limitation to the present invention. In an alternative design, the processing unit 206 is allowed to employ other algorithm to generate the desired dimming value according to multiple characteristic values. Details of the data analysis module 200 in FIG. 4 are as follows.

Regarding a first frame (e.g., a current frame), the first extraction unit 202 and the second extraction unit 204 receive a plurality of first pixel values $P_{cur}$ respectively corresponding to the pixels 106 of the display area 104 on the display panel, and derive a first characteristic value $CV_{cur}$ and a second value $AV_{cur}$, respectively. The processing unit 206 generates a first dimming value $DV_{cur}$ according to the first characteristic value $CV_{cur}$ and the second characteristic value $AV_{cur}$. In one exemplary implementation, the processing unit 206 may be configured to perform a weighted blending operation upon the first characteristic value $CV_{cur}$ and the second characteristic value $AV_{cur}$ to generate a weighted blending result (e.g., $W*AV_{cur}+(1-W)*CV_{cur}$), where the first dimming value $DV_{cur}$ is derived from the weighted blending result. By way of example, but not limitation, the weighting factor W ($0 \leqq W \leqq 1$) referenced by the processing unit 206 may be programmable.

Similarly, regarding other frames, the data analysis module 200 follows the same procedure mentioned above to derive the corresponding dimming values. Taking a second frame (e.g., a previous frame) preceding the first frame for example, each of the first extraction unit 202 and the second extraction unit 204 receives a plurality of second pixel values $P_{pre}$ corresponding to the pixels 106 of the display area 104 on the display panel, respectively. Based on the received second pixel values $P_{pre}$, the first extraction unit 202 generates a third characteristic value $CV_{pre}$ and the second extraction unit 204 generates a fourth characteristic value $AV_{pre}$. Next, the processing unit 206 generates a second dimming value $DV_{pre}$ according to the third characteristic value $CV_{pre}$ and the fourth characteristic value $AV_{pre}$. As a skilled person in the art can readily understand details directed to generating the second dimming value $DV_{pre}$ after reading above paragraphs directed to generating the first dimming value $DV_{cur}$, further description is omitted here for brevity.

By way of example, but not limitation, at least one of the first extraction unit 202 and the second extraction unit 204 may be implemented using a combination of the statistics unit 402 and the decision unit 404 as shown in FIG. 2. For instance, the first extraction unit 202 is configured to have the statistics unit 402 and the decision unit 404 implemented therein, and the output of the decision unit 404 directly acts as the characteristic value output of the first extraction unit 202. In addition, the second extraction unit 204 may be configured to calculate an average value of the received pixel values (e.g., $P_{pre}$ or $P_{cur}$), and then output the average value as a characteristic value. Such an alternative design also obeys the spirit of the present invention. Briefly summarized, any data analysis module using a plurality of characteristic values derived from the same pixel data to determine a dimming value output falls within the scope of the present invention.

Please refer to FIG. 1 again. The spatial filter 116 is implemented to perform a spatial filtering operation upon the dimming value output DV to generate a spatial filter output DV'. Taking the spatial filtering of the first dimming value $DV_{cur}$ generated by the data analysis module 112 for example, the spatial filter 116 refers to a spatial filter setting, the first dimming value $DV_{cur}$, and dimming values of display areas surrounding the display area 104 to determine a corresponding filtered dimming value, where the first dimming value $DV_{cur}$ and the other dimming values are derived according to pixel values of the same frame (e.g., the current frame). It should be noted that the spatial filter setting may be programmable to selectively disable the spatial filtering operation or determine how the dimming value output DV is filtered. In one exemplary implementation, the spatial filter 116 may employ any conventional spatial filter architecture, and further description is omitted here for brevity.

As shown in FIG. 1, the spatial filter output DV' generated from the spatial filter 116 will undergo a following temporal filtering operation performed by the temporal filter 118, and the interface controller 120, which acts as an interface between the dimming control apparatus 100 and the backlight module (not shown), transmits a dimming control output to the backlight module according to a temporal filter output DV". For example, a dimming control signal S_DC which may carry a desired luminance value generated according to a temporal filtering result corresponding to pixel values of the pixels 106 is used to control the backlight unit 102 which is involved in setting the backlight intensity of the display area 104.

Figure 5:
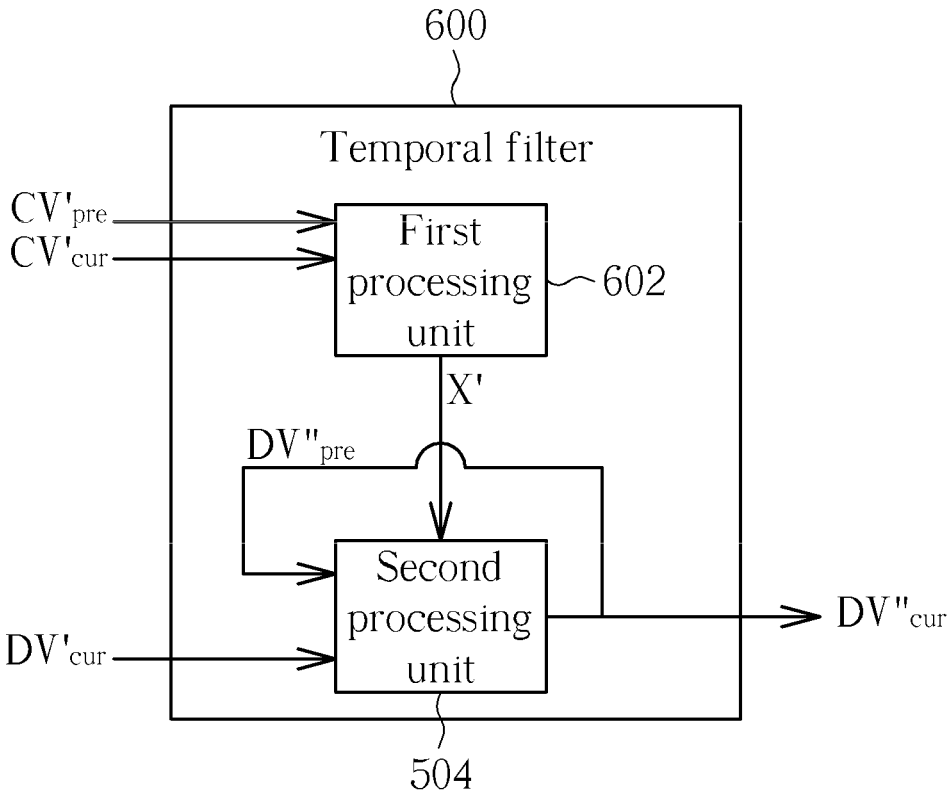
FIG. 5 shows a first exemplary implementation of a temporal filter shown in FIG. 1.

Please refer to FIG. 5, which shows a first exemplary implementation of the temporal filter 118 shown in FIG. 1. The temporal filter 600 includes a first processing unit 602 and a second processing unit 504. In a case where the data analysis module 112 shown in FIG. 1 is implemented by the data analysis module 400 shown in FIG. 2, the temporal filter 600 receives the first characteristic value $CV'_{cur}$ and the second characteristic value $CV'_{pre}$ from the data analysis module 400. The first processing unit 602 is therefore configured to determine a weighting factor X' ($0 \leqq X' \leqq 1$) according to the first characteristic value $CV'_{cur}$ and the second characteristic value $CV'_{pre}$. The second processing unit 504 is configured to perform a weighted blending operation upon a current dimming value $DV'_{cur}$ corresponding to the first dimming value $DV_{cur}$ and a previous dimming value $DV''_{pre}$ corresponding to the second dimming value $DV_{pre}$. In this exemplary implementation, the first dimming value $DV'_{cur}$ is derived from a spatial filtering result of the first dimming value $DV_{cur}$, and the previous dimming value $DV''_{pre}$ is derived from a temporal filtering result of the second dimming value $DV_{pre}$. As can be clearly seen from FIG. 5, a temporal filtering result $DV''_{cur}$ of the first dimming value $DV_{cur}$ will be fed back to serve as a previous dimming value when the temporal filter 500 performs a temporal filtering operation upon a next dimming value following the first dimming value $DV_{cur}$, where $DV''cur = X'*DV'_{cur}(1-X')*DV'_{pre}$.

It should be noted that the exemplary embodiment shown in FIG. 5 is for illustrative purposes only. Any temporal filter which generates the temporal filter output (e.g., the dimming control signal) according to a current dimming value corresponding to the first dimming value $DV_{cur}$, a previous dimming value corresponding to the second dimming value $DV_{pre}$, the first characteristic value $CV'_{cur}$ and the second characteristic value $CV'_{pre}$ obeys the spirit of the present invention.

Figure 6:
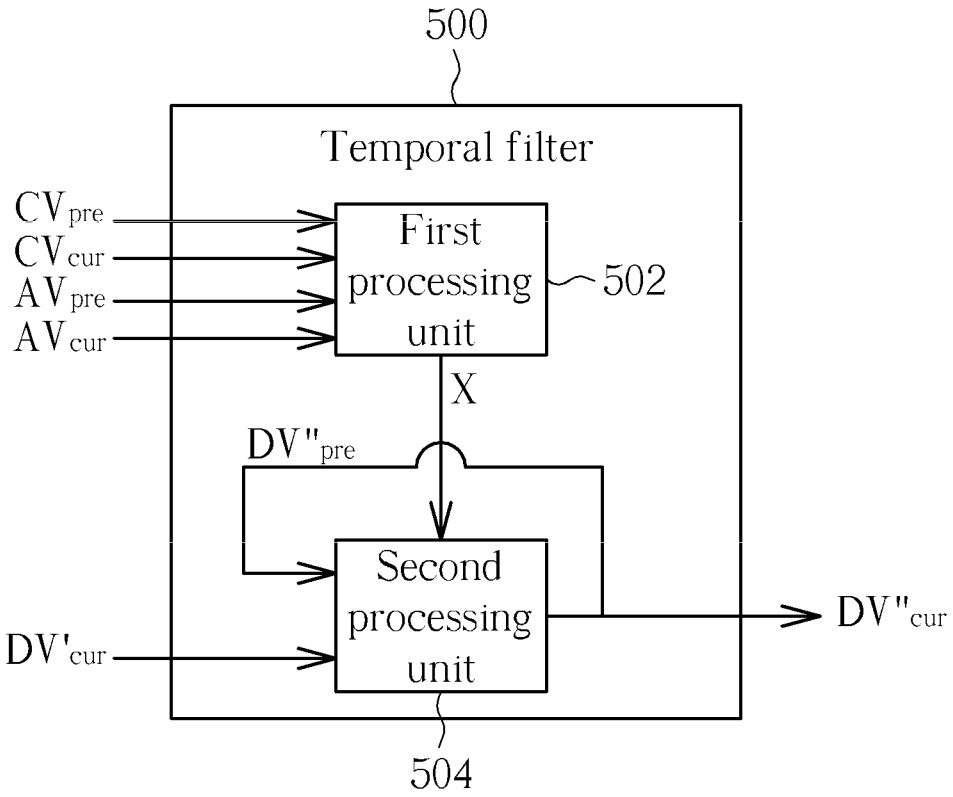
FIG. 6 shows a second exemplary implementation of the temporal filter shown in FIG. 1.

Please refer to FIG. 6, which shows a second exemplary implementation of the temporal filter 118 shown in FIG. 1. The temporal filter 500 includes a first processing unit 502 and a second processing unit 504. In a case where the data analysis module 112 shown in FIG. 1 is implemented by the data analysis module 200 shown in FIG. 4, the temporal filter 500 receives the first characteristic value $CV_{cur}$, the third characteristic value $CV_{pre}$, the second characteristic value $AV_{cur}$, and the fourth characteristic value $AV_{pre}$ from the data analysis module 200. The first processing unit 502 is configured to determine a weighting factor X ($0 \leqq X \leqq 1$) according to the first characteristic value $CV_{cur}$, the third characteristic value $CV_{pre}$, the second characteristic value $AV_{cur}$, and the fourth characteristic value $AV_{pre}$. Similarly, based on the weighting factor X set by the first processing unit 502, the second processing unit 504 performs the weighted blending operation upon the current dimming value DV'cur and the previous dimming value $DV''_{pre}$ to generate the temporal filter result $DV''_{cur}$ of the current dimming value $DV'_{cur}$. It should be noted that the exemplary embodiment shown in FIG. 6 is for illustrative purposes only. Any temporal filter which generates the temporal filter output (e.g., the dimming control signal) according to a current dimming value corresponding to the first dimming value $DV_{cur}$, a previous dimming value corresponding to the second dimming value $DV_{pre}$, the first characteristic value $CV_{cur}$, the second characteristic value $AV_{cur}$, the third characteristic value $CV_{pre}$, and the fourth characteristic value $AV_{pre}$ obeys the spirit of the present invention.

Figure 7:
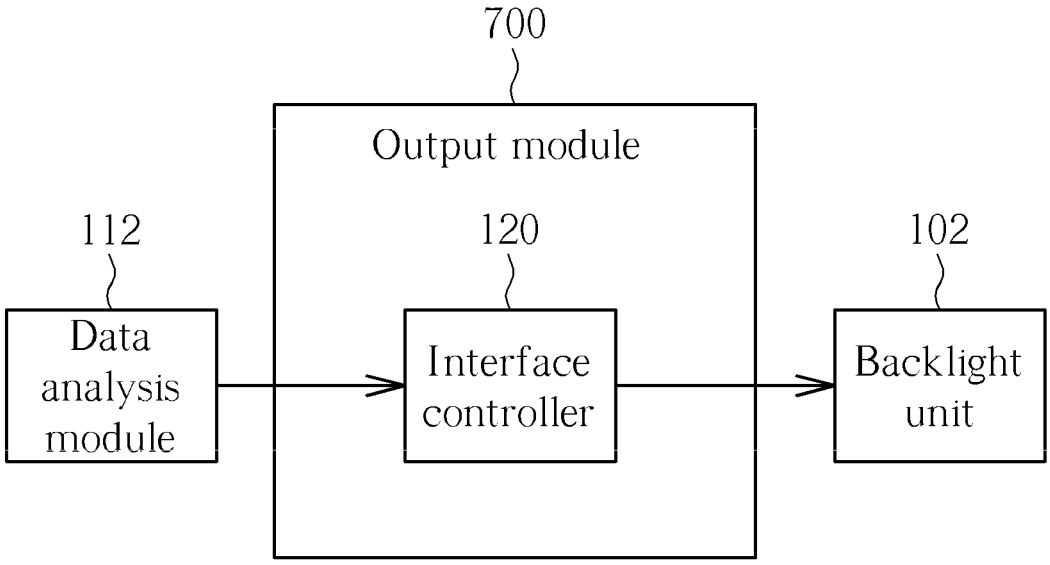
FIG. 7 shows one alternative design of an output module shown in FIG. 1.
Figure 8:
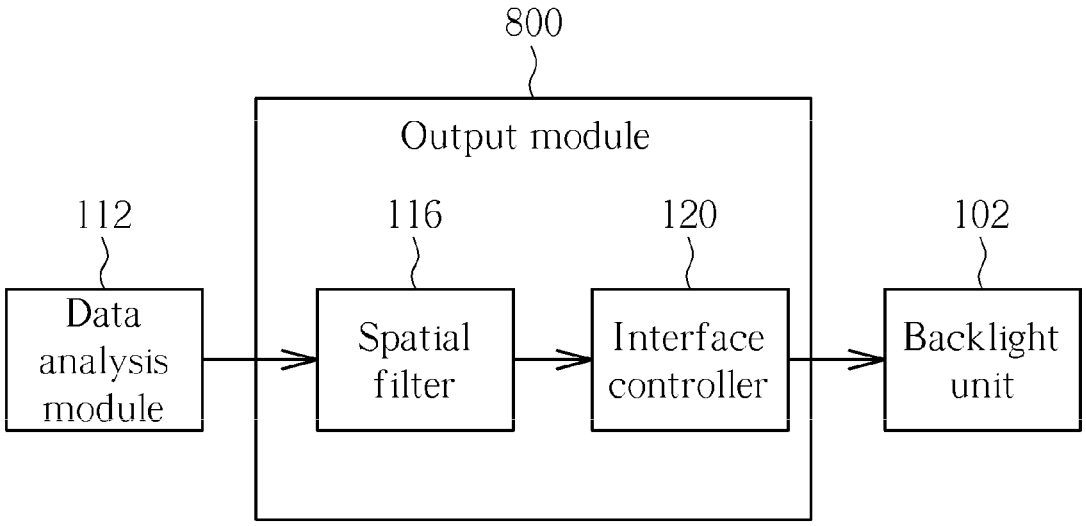
FIG. 8 shows another alternative design of the output module shown in FIG. 1.
Figure 9:
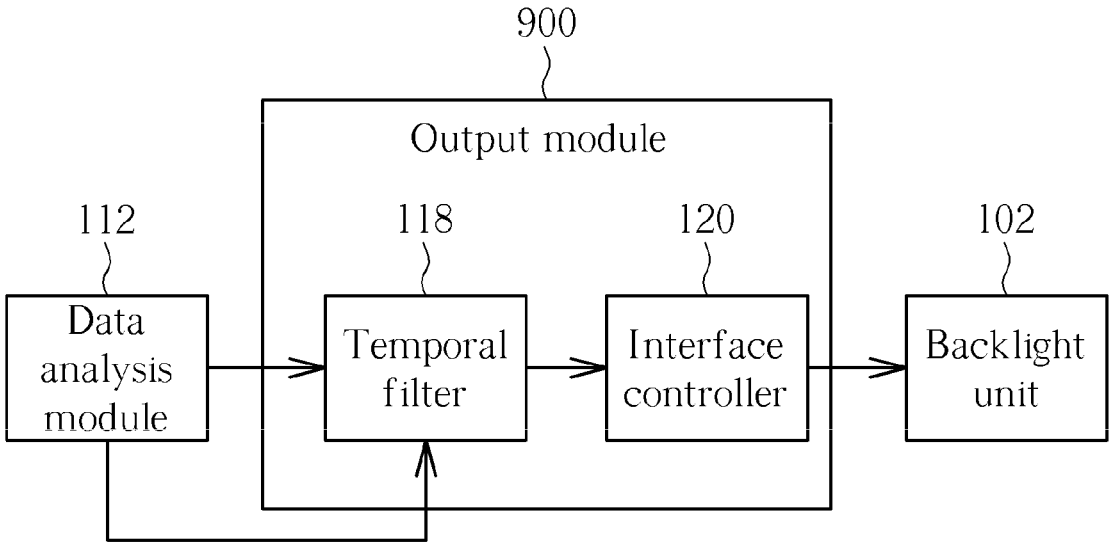
FIG. 9 shows yet another alternative design of the output module shown in FIG. 1.

In the exemplary embodiment shown in FIG. 1, the output module 114 is implemented to generate the dimming control signal S_DC according to at least the dimming value output DV generated from the data analysis module 112. However, provided that the same objective of generating the desired dimming control signal S_DC is achieved, the architecture of the output module 114 is not limited to that shown in FIG. 1. Alternative designs of the output module 114 are shown in FIG. 7-FIG. 9, respectively. The output module 700 shown in FIG. 7 includes the interface controller 120. Therefore, the dimming value output of the data analysis module 112 would serve as the dimming control signal generated from the dimming control apparatus. The output module 800 shown in FIG. 8 includes the spatial filter 116 and the interface controller 120. Therefore, the spatial filtering result generated from performing a spatial filtering operation upon the dimming value output of the data analysis module 112 would serve as the dimming control signal generated from the dimming control apparatus. The output module 900 shown in FIG. 9 includes the temporal filter 118 and the interface controller 120. Therefore, the temporal filtering result generated from performing a temporal filtering operation upon the dimming value output of the data analysis module 112 would serve as the dimming control signal generated from the dimming control apparatus. Briefly summarized, any output module which generates a dimming control signal according to at least the dimming value output generated from referring to a distribution (e.g., a histogram) of pixel values falls within the scope of the present invention.

Please note that the aforementioned data analysis module, spatial filter, and/or temporal filter may be implemented using hardware, software, or a combination thereof.

Figure 10:
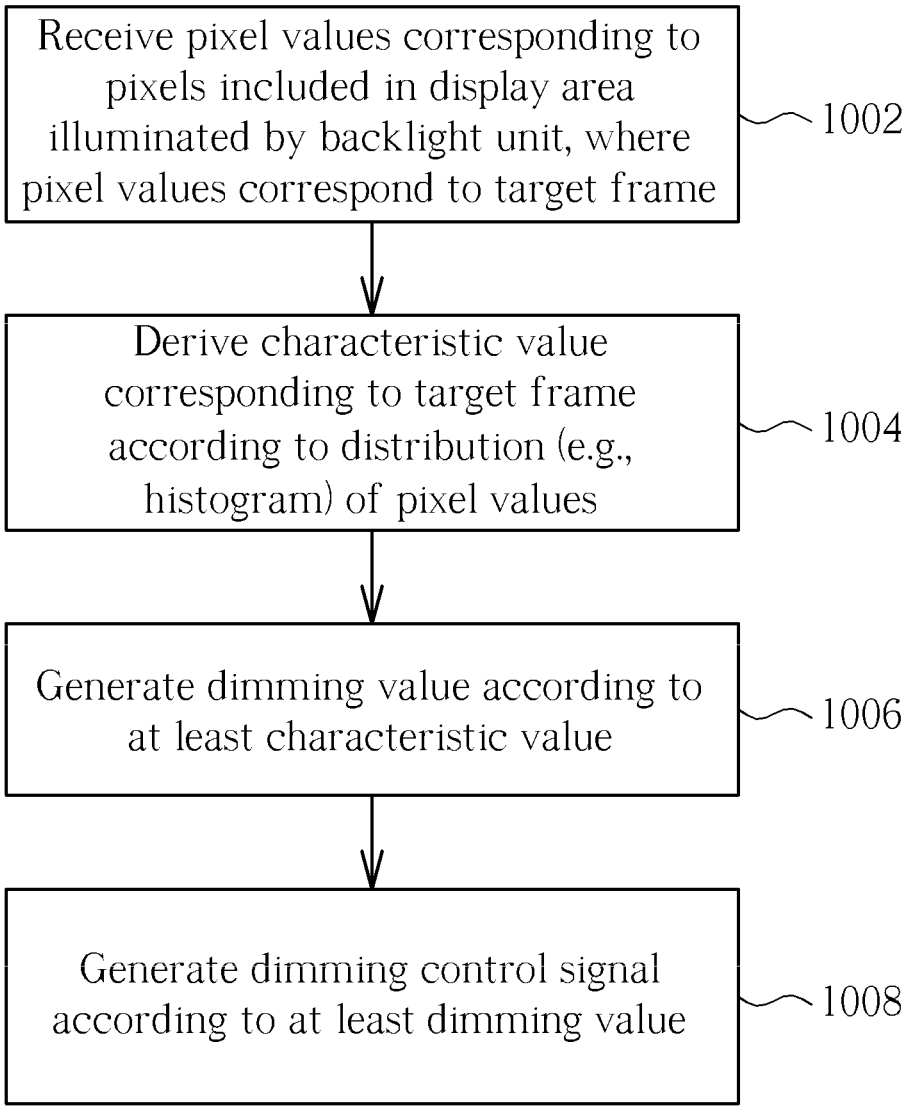
FIG. 10 is a flowchart of one generalized dimming control method of generating a dimming control signal for a display area.

FIG. 10 is a flowchart of a generalized dimming control method of generating a dimming control signal for a display area. If the result is substantially the same, the steps are not required to be executed in the exact order shown in FIG. 10. The exemplary dimming control method can be briefly summarized as follows.

Step 1002: Receive a plurality of pixel values corresponding to a plurality of pixels included in the display area, respectively, where the pixel values correspond to a target frame.

Step 1004: Derive a characteristic value corresponding to the target frame according to a distribution (e.g., a histogram) of the pixel values.

Step 1006: Generate a dimming value according to at least the characteristic value.

Step 1008: Generate a dimming control signal according to at least the dimming value.

Figure 11:
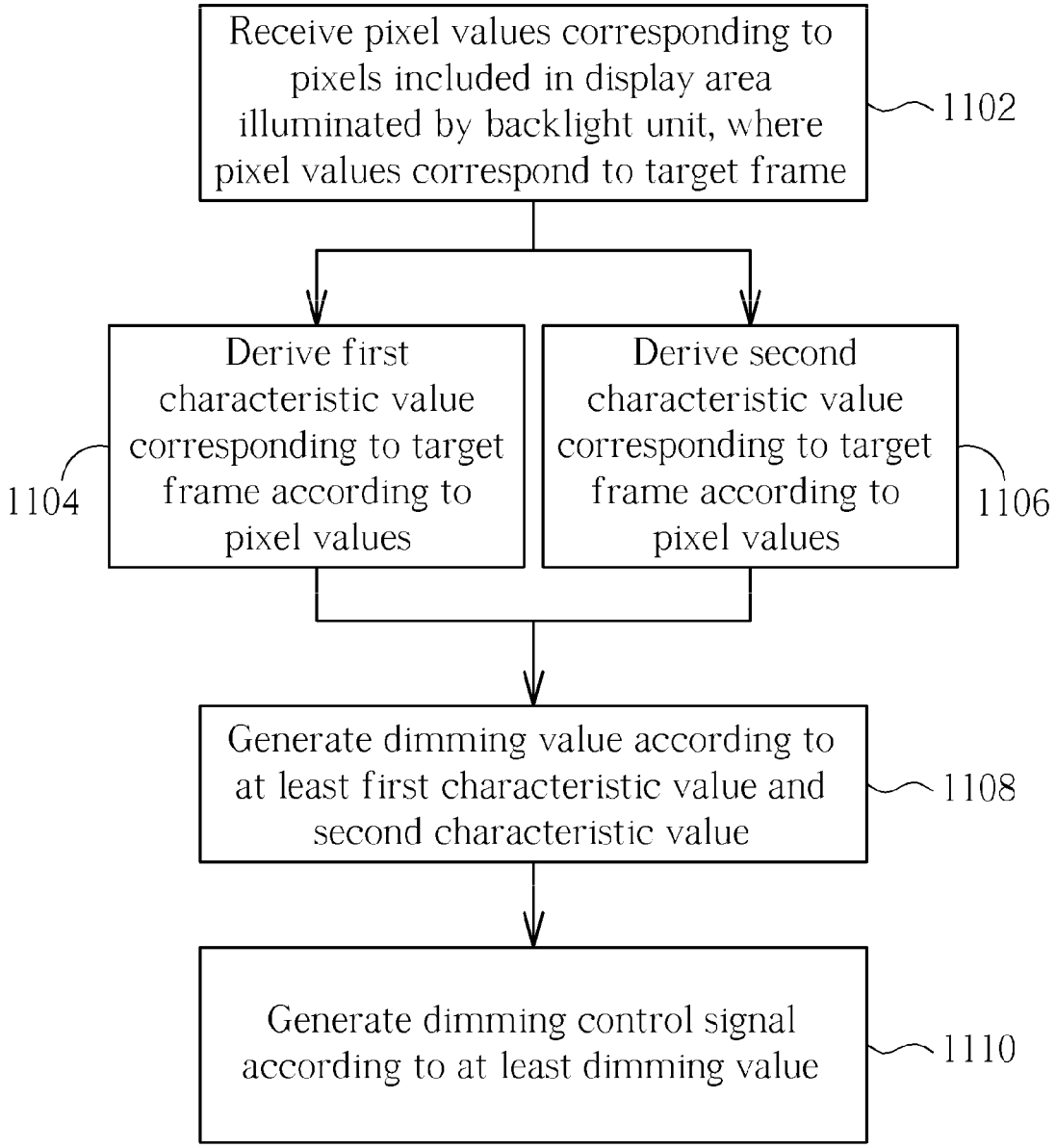
FIG. 11 is a flowchart of another generalized dimming control method of generating a dimming control signal for a display area.

FIG. 11 is a flowchart of another generalized dimming control method of generating a dimming control signal for a display area. If the result is substantially the same, the steps are not required to be executed in the exact order shown in FIG. 11. The exemplary dimming control method can be briefly summarized as follows.

Step 1102: Receive a plurality of pixel values corresponding to a plurality of pixels included in the display area, respectively, where the pixel values correspond to a target frame. Proceed with steps 1104 and 1106.

Step 1104: Derive a first characteristic value corresponding to the target frame according to the pixel values. Go to step 1108.

Step 1106: Derive a second characteristic value corresponding to the target frame according to the pixel values.

Step 1108: Generate a dimming value according to at least the first characteristic value and the second characteristic value.

Step 1110: Generate the dimming control signal according to at least the dimming value.

Please note that steps 1104 and 1106 are not required to be executed in a parallel manner. In an alternative design, steps 1104 and 1106 may be executed in a sequential manner.

As the details of the exemplary dimming control methods shown in FIG. 10 and FIG. 11 can be found in above paragraphs directed to the block diagrams shown in the accompanying drawings, further description is omitted here for brevity.

Those skilled in the art will readily observe that numerous modifications and alterations of the device and method may be made while retaining the teachings of the invention.

What is claimed is:

1. A dimming control apparatus of generating a dimming control signal for a display area including a plurality of pixels, comprising:

a data analysis module, comprising:

a plurality of extraction units, comprising:

a first extraction unit, for receiving a plurality of first pixel values corresponding to the pixels, respectively, where the first pixel values correspond to a first frame; and for deriving a first characteristic value corresponding to the first frame according to the first pixel values; and a second extraction unit, for receiving the first pixel values and deriving a second characteristic value corresponding to the first frame according to the first pixel values; and a processing unit, coupled to the extraction units, for generating the first dimming value according to at least the first characteristic value and the second characteristic value; and an output module, coupled to the data analysis module, for generating the dimming control signal corresponding to the first frame according to at least the first dimming value.

2. The dimming control apparatus of claim 1, wherein the processing unit performs a weighted blending operation upon at least the first characteristic value and the second characteristic value to generate a weighted blending result, where the first dimming value is derived from the weighted blending result.

3. The dimming control apparatus of claim 1, wherein the first extraction unit further derives a third characteristic value corresponding to a second frame according to a plurality of second pixel values corresponding to the pixels, respectively, where the second frame precedes the first frame; the second extraction unit further derives a fourth characteristic value of the second pixel values corresponding to the second frame; the processing unit further generates a second dimming value according to at least the third characteristic value and the fourth characteristic value; and the output module generates the dimming control signal according to a current dimming value corresponding to the first dimming value, a previous dimming value corresponding to the second dimming value, the first characteristic value, the second characteristic value, the third characteristic value, and the fourth characteristic value.

4. The dimming control apparatus of claim 3, wherein the output module comprises:

a temporal filter, for performing a weighted blending operation upon the current dimming value and the previous dimming value according to the first characteristic value, the second characteristic value, the third characteristic value, and the fourth characteristic value, and accordingly generates a weighted blending result; and an interface controller, coupled to the temporal filter, for outputting the dimming control signal generated according to at least the weighted blending result.

5. A dimming control apparatus of generating a dimming control signal for a display area including a plurality of pixels, comprising:

a data analysis module, for receiving a plurality of first pixel values corresponding to the pixels, respectively, where the first pixel values correspond to a first frame; deriving a first characteristic value corresponding to the first frame by referring to a distribution of the first pixel values; and generating a first dimming value according to at least the first characteristic value; and an output module, coupled to the data analysis module, for generating the dimming control signal corresponding to the first frame according to at least the first dimming value.

6. The dimming control apparatus of claim 5, wherein the data analysis module comprises:

a plurality of extraction units, comprising:

a first extraction unit, for receiving the first pixel values and deriving the first characteristic value according to the distribution of the first pixel values; and a second extraction unit, for receiving the first pixel values and deriving a second characteristic value corresponding to the first frame according to the first pixel values; and a processing unit, coupled to the extraction units, for generating the first dimming value according to at least the first characteristic value and the second characteristic value.

7. The dimming control apparatus of claim 6, wherein the processing unit performs a weighted blending operation upon at least the first characteristic value and the second characteristic value to generate a weighted blending result, where the first dimming value is derived from the weighted blending result.

8. The dimming control apparatus of claim 6, wherein the first extraction unit further derives a third characteristic value corresponding to a second frame according to a distribution of a plurality of second pixel values corresponding to the pixels, respectively, where the second frame precedes the first frame; the second extraction unit further derives a fourth characteristic value of the second pixel values corresponding to the second frame; the processing unit further generates a second dimming value according to at least the third characteristic value and the fourth characteristic value; and the output module generates the dimming control signal according to a current dimming value corresponding to the first dimming value, a previous dimming value corresponding to the second dimming value, the first characteristic value, the second characteristic value, the third characteristic value, and the fourth characteristic value.

9. The dimming control apparatus of claim 8, wherein the output module comprises:

a temporal filter, for performing a weighted blending operation upon the current dimming value and the previous dimming value according to the first characteristic value, the second characteristic value, the third characteristic value, and the fourth characteristic value, and accordingly generates a weighted blending result; and an interface controller, coupled to the temporal filter, for outputting the dimming control signal generated according to at least the weighted blending result.

10. The dimming control apparatus of claim 5, wherein the data analysis module comprises:

a statistics unit, for generating a first statistics result according to the distribution of the first pixel values; and a decision unit, coupled to the statistics unit, for deriving the first characteristic value according to the first statistics result, and outputting the first characteristic value as the first dimming value.

11. The dimming control apparatus of claim 10, wherein the first statistics result is a histogram of the first pixel values.

12. The dimming control apparatus of claim 10, wherein:

the statistics unit further generates a second statistics result according to a plurality of second pixel values respectively corresponding to the pixels in a second frame, where the second frame precedes the first frame;

the decision unit further derives a second characteristic value according to the second statistics result, and outputs the second characteristic value as a second dimming value; and the output module generates the dimming control signal according to a current dimming value derived from at least the first dimming value, a previous dimming value derived from at least the second dimming value, the first characteristic value, and the second characteristic value.

13. The dimming control apparatus of claim 12, wherein the output module comprises:

a temporal filter, for performing a weighted blending operation upon the current dimming value and the previous dimming value according to the first characteristic value and the second characteristic value, and accordingly generates a weighted blending result; and an interface controller, coupled to the temporal filter, for outputting the dimming control signal generated according to at least the weighted blending result.

14. A dimming control method of generating a dimming control signal for a display area including a plurality of pixels, comprising:

receiving a plurality of first pixel values corresponding to the pixels, respectively, where the first pixel values correspond to a first frame;

deriving a first characteristic value corresponding to the first frame by referring to a distribution of the first pixel values;

generating a first dimming value according to at least the first characteristic value; and generating the dimming control signal corresponding to the first frame according to at least the first dimming value.

15. The dimming control method of claim 14, further comprising:

deriving a second characteristic value corresponding to the first frame according to the first pixels;

wherein the step of deriving the first dimming value comprises:

generating the first dimming value according to at least the first characteristic value and the second characteristic value.

16. The dimming control method of claim 15, wherein the step of generating the first dimming value comprises:

performing a weighted blending operation upon the first characteristic value and the second characteristic value to generate a weighted blending result; and deriving the first dimming value from the weighted blending result.

17. The dimming control method of claim 15, further comprising:

deriving a third characteristic value corresponding to a second frame according to a distribution of a plurality of second pixel values corresponding to the pixels, respectively;

deriving a fourth characteristic value of the second pixel values corresponding to the second frame which precedes the first frame; and generating a second dimming value according to the third characteristic value and the fourth characteristic value;

wherein the step of generating the dimming control signal comprises:

deriving the dimming control signal according to a current dimming value corresponding to the first dimming value, a previous dimming value corresponding to the second dimming value, the first characteristic value, the second characteristic value, the third characteristic value, and the fourth characteristic value.

18. The dimming control method of claim 17, wherein the step of deriving the dimming control signal comprises:

performing a weighted blending operation upon the current dimming value and the previous dimming value according to the first characteristic value, the second characteristic value, the third characteristic value, and the fourth characteristic value, and accordingly generating a weighted blending result; and generating the dimming control signal according to at least the weighted blending result.

19. The dimming control method of claim 14, wherein:

the step of deriving the first characteristic value comprises:

generating a first statistics result according to the distribution of the first pixel values; and deriving the first characteristic value according to the first statistics result; and the step of generating the first dimming value comprises:

outputting the first characteristic value as the first dimming value.

20. The dimming control method of claim 19, wherein the first statistics result is a histogram of the first pixel values.

21. The dimming control method of claim 19, further comprising:

generating a second statistics result according to a plurality of second pixel values respectively corresponding to the pixels in a second frame, where the second frame precedes the first frame;

deriving a second characteristic value according to the second statistics result, and outputting the second characteristic value as a second dimming value;

wherein the step of generating the dimming control signal comprises:

deriving the dimming control signal according to a current dimming value derived from at least the first dimming value, a previous dimming value derived from at least the second dimming value, the first characteristic value, and the second characteristic value.

22. The dimming control method of claim 21, wherein the step of deriving the dimming control signal comprises:

performing a weighted blending operation upon the current dimming value and the previous dimming value according to the first characteristic value and the second characteristic value, and accordingly generating a weighted blending result; and generating the dimming control signal according to at least the weighted blending result.

23. A dimming control method of generating a dimming control signal for a display area including a plurality of pixels, comprising:

receiving a plurality of first pixel values corresponding to the pixels, respectively, where the first pixel values correspond to a first frame;

deriving a first characteristic value corresponding to the first frame according to the first pixel values; and deriving a second characteristic value corresponding to the first frame according to the first pixel values;

generating a first dimming value according to at least the first characteristic value and the second characteristic value; and generating the dimming control signal corresponding to the first frame according to at least the first dimming value.

24. The dimming control method of claim 23, wherein the step of generating the first dimming value comprises:

performing a weighted blending operation upon at least the first characteristic value and the second characteristic value to generate a weighted blending result; and deriving the first dimming value from the weighted blending result.

25. The dimming control method of claim 23, further comprising:

deriving a third characteristic value corresponding to a second frame according to a plurality of second pixel values corresponding to the pixels, respectively;

deriving a fourth characteristic value of the second pixel values corresponding to the second frame which precedes the first frame;

generating a second dimming value according to at least the third characteristic value and the fourth characteristic value; and the step of generating the dimming control signal comprises:

deriving the dimming control signal according to a current dimming value corresponding to the first dimming value, a previous dimming value corresponding to the second dimming value, the first characteristic value, the second characteristic value, the third characteristic value, and the fourth characteristic value.

26. The dimming control method of claim 25, wherein the step of deriving the dimming control signal comprises:

performing a weighted blending operation upon the current dimming value and the previous dimming value according to the first characteristic value, the second characteristic value, the third characteristic value, and the fourth characteristic value, and accordingly generates a weighted blending result; and generating the dimming control signal according to at least the weighted blending result.

* * * * *